US005775138A

United States Patent [19]

Durazzani et al.

[11] Patent Number: 5,775,138

[45] Date of Patent: Jul. 7, 1998

[54] ARRANGEMENT FOR MOUNTING THE MOTOR IN A CLOTHES WASHING MACHINE

[75] Inventors: Piero Durazzani, Porcia; Roberto Quattrin, Murlis di Zoppola, both of Italy

[73] Assignee: Electrolux Zanussi Elettrodomestici, S.P.A., Pordenone, Italy

[21] Appl. No.: 843,538

[22] Filed: Apr. 18, 1997

[30] Foreign Application Priority Data

May 22, 1996 [IT] Italy ..... PN96A0029

[51] Int. Cl.[6] ..... D06F 37/20

[52] U.S. Cl. ..... 68/140; 68/23.1

[58] Field of Search ..... 68/140, 23.1, 24, 68/23.3, 23.6; 34/121, 601; 310/51

[56] References Cited

U.S. PATENT DOCUMENTS

| | | | |
|---|---|---|---|
| 2,214,131 | 9/1940 | Haberstump | 68/140 |
| 2,526,048 | 10/1950 | Russell | 68/23.1 |
| 2,842,002 | 7/1958 | Stegman | 68/140 |
| 3,197,983 | 8/1965 | Llmer | 68/23.1 |
| 3,283,600 | 11/1966 | Buck | 68/140 |
| 4,471,248 | 9/1984 | Smetana | 310/51 |
| 5,394,039 | 2/1995 | Suchdev et al. | 310/51 |
| 5,520,029 | 5/1996 | Savkar | 68/23.1 |
| 5,694,795 | 12/1997 | Knopp | 68/140 |

*Primary Examiner*—Amy B. Vanatta

*Attorney, Agent, or Firm*—Pearne, Gordon, McCoy and Granger LLP

[57] ABSTRACT

An arrangement for mounting the motor in a clothes washing machine for the purpose of reducing the noise produced by the machine during operation thereof. The electric motor (10) is fixed to the tub of the machine on brackets (12) provided with seats (13) for accommodating the shaft (16). Shock absorbing means (14–15) are provided within the seats (13), as well as an elastic element (17) for connecting the motor (10) to at least one of the brackets (12).

9 Claims, 2 Drawing Sheets

ARRANGEMENT FOR MOUNTING THE MOTOR IN A CLOTHES WASHING MACHINE

BACKGROUND OF THE INVENTION

The present invention concerns an arrangement for mounting the motor in a clothes washing machine, such as a domestic type washer, for the purpose of reducing the noise produced by the machine during operation thereof.

In the washing phases the main factors which influence the noise produced by the machine are as follows: the loading of water in the tub of the machine, the type of electric motor which drives the drum containing the laundry in rotation, the nature and the form of the acoustic insulation with which the machine is equipped, and the speed of rotation of the drum.

In the spin phases the main factors which influence the noise produced by the machine are as follows: the spin speed, the type of motor, the unbalance of the load of laundry in the drum, and the acoustic insulation involved.

The present invention deals with the problem of noise due to the vibrations which are produced by the electric motor for actuating the drum and which cause the structure of the machine to resonate.

The motor for actuating the drum is generally rigidly mounted to the exterior of the washing tub by means of brackets and tie members which connect the motor to supports which are fixed with respect to the tub. Such a construction means that it is inevitable that the vibration of the motor will be transmitted to the entire structure of the machine, with the adverse result of causing it to resonate. That occurs in particular at low frequencies (200 to 400 Hz) when the vibrations of the motor coincide with the natural vibrations of the washing tub.

The vibrations of the motor occur in an axial direction and in a radial direction and in a tangential direction, that is in the plane orthogonal to the motor axis. The vibrations are due both to the type of electrical power supply and to the rigid fixing between the motor and the tub. The electrical power supply may involve alternating current at a mains frequency of 50 Hz or 60 Hz and multiples thereof, or direct current, with a choked and rectified pulsating wave. Both the alternating current and the pulsating direct current produce vibrations which are transmitted from the motor to the machine by way of the associated fixing members.

A construction which practically eliminates vibration involves the use of a motor which is supplied with direct current, with a control known as a "chopper" (involving modulation), in which the current is of a positive square wave shape with an elevated frequency (15 to 20 khz), which does not interfere with that which is characteristic of the structure of the machine. However, that arrangement involves a specific control device at a cost which is markedly increased in comparison with the normal construction of an alternating current motor.

BRIEF SUMMARY OF THE INVENTION

The aim of the present invention is to resolve the problem of noise produced in clothes washing machines by means of a very simple and economic mechanical construction. This involves modifying the mounting for the motor, in particular using shock absorbing means interposed between the shaft of the motor and the seat in the associated support bracket for same.

According to the present invention, a clothes washing machine is provided with a washing tub within which is a rotatable drum for containing the laundry to be washed. The drum is drivable in rotation by an electric motor which is mounted in the lower part and on the outside of the tub by means of two brackets provided with seats for accommodating the motor shaft. The seats are provided with shock absorbing means capable of permitting absorption of the vibration which is generated on the motor shaft during operation of the motor.

BRIEF DESCRIPTION OF THE SEVERAL VIEWS OF THE DRAWING

Advantages and features of the present invention will be apparent from the following description given by way of non-limiting example with reference to the accompanying drawings in which.

DESCRIPTION OF THE INVENTION

Figure 1:
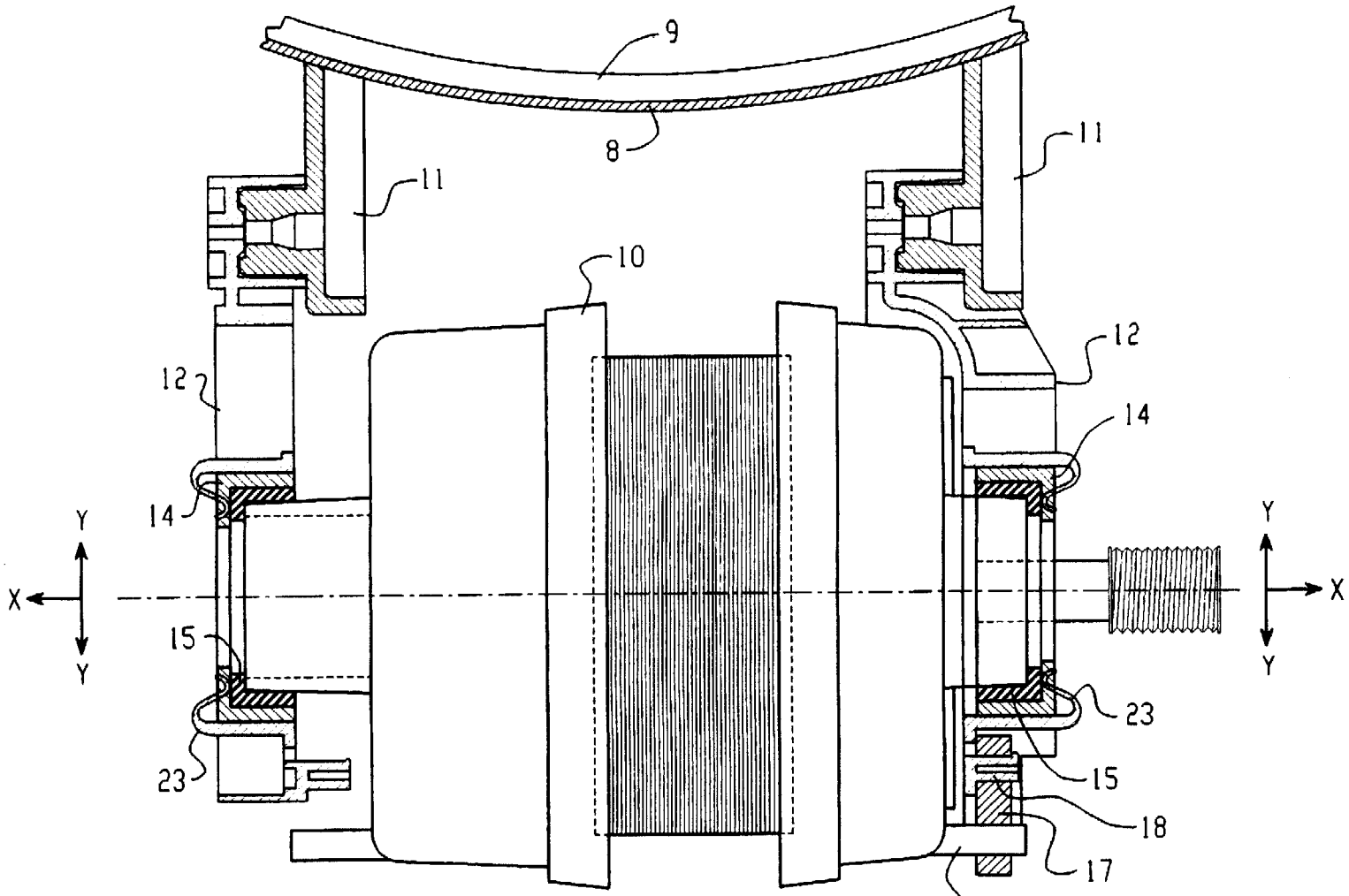
FIG. 1 is a partly sectional view of a motor and mount for a clothes washing machine according to the invention.
Figure 2:
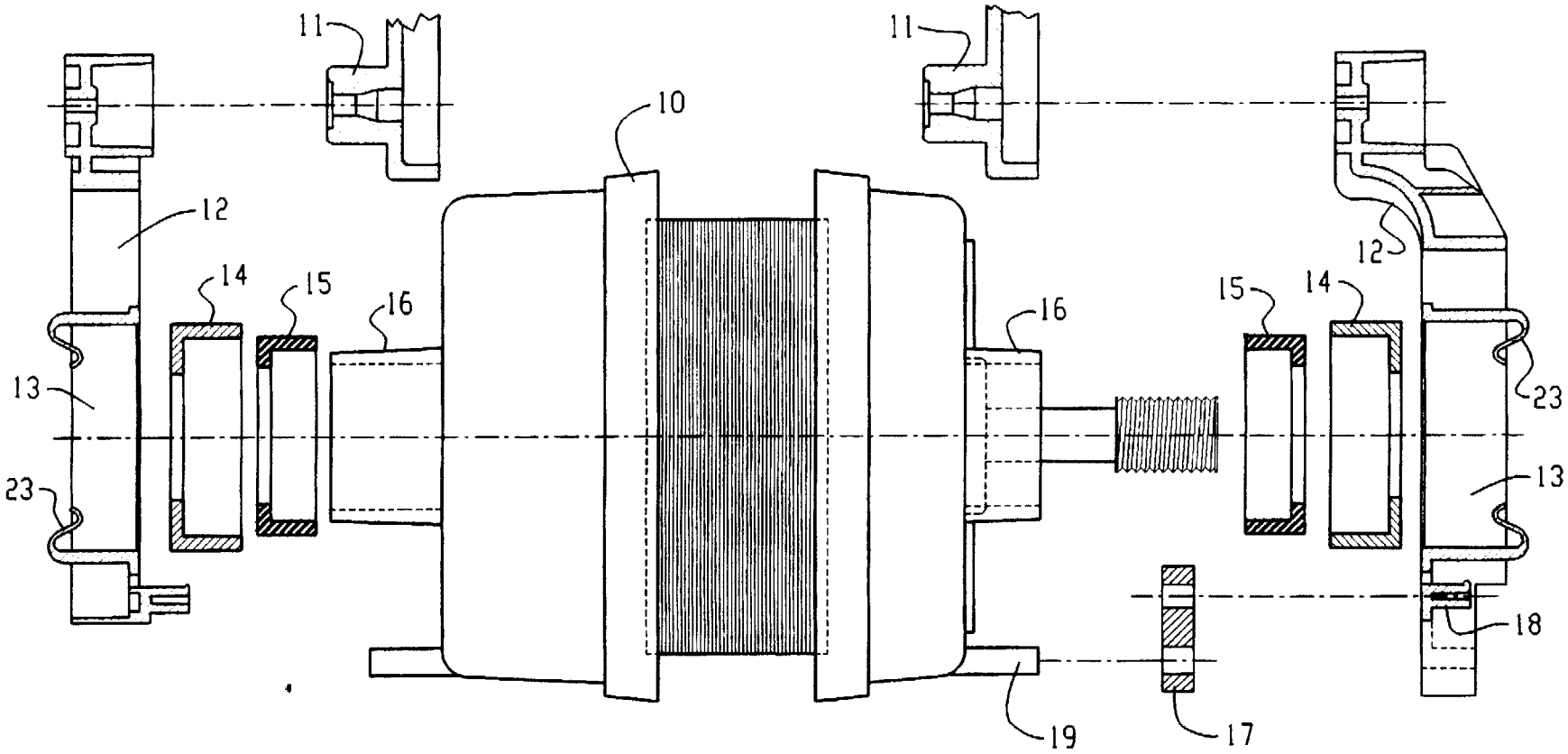
FIG. 2 is a partly sectional view of the motor and mount of FIG. 1 with its components in an axially exploded condition.

Referring to FIGS. 1 and 2, the washer includes a tub 8 with a drum 9 rotated therein by an electric motor 10. The electric motor 10 is of a conventional type, for example an asynchronous motor supplied with alternating current, or a universal motor supplied with a direct current (pulsating) or alternating current.

The motor 10 is fixed in the lower part of the tub 8 of the clothes washing machine on two supports 11 which are fixed with respect to the tub.

Mounted on each support 11 is one end of a stirrup or bracket 12 which extends downwardly and which is provided in the body thereof with a seat 13 for the shaft of the motor. Accommodated in each seat 13 is a bushing 14 of self-lubricating material (for example Hostaform, registered trademark), into which is inserted a shock absorbing ring 15. The ring 15 is preferably of rubber. The shaft 16 of the motor 10 is thus mounted elastically in the seats 13 by way of the elastic support means 14–15.

It is noted that the brackets 12 are also normally made of plastic material (preferably Carboran, registered trademark). The seats 13 can have an inwardly curved edge 23, as shown in the Figures. The edge 23 can flex elastically, increasing the capacity for absorption of the vibrations of the motor shaft 16 in the axial direction. Indeed the edge 23 constitutes an axial abutment for the corresponding bushing 14.

In addition, at least at one end of the motor 10, a rubber element 17 interconnects a pin 18 provided on the bracket 13 and a pin 19 provided on the casing of the motor 10. As shown more clearly in FIG. 2, the element 17 is preferably elongated downwardly and is suitably provided with two through holes for insertion of the pins 18 and 19 which are mutually displaced in a vertical direction. The element 17 absorbs vibrations of the motor 10 in a direction (y) orthogonal to the motor axis (x), thus contributing to reducing the vibration and the noise produced.

In substance, the invention proposes a solution in which the motor is mounted on the clothes washing machine without rigid connections in such a way as to absorb the vibration generated in operation and to avoid transmission thereof to the entire structure of the machine.

The above-described elastic connecting and support elements have been demonstrated experimentally to be capable of reducing by 6 to 10 dBA the noise produced by the clothes washing machine due to operation of the electric motor which drives the drum in rotation. Therefore, using this simple and economical mechanical construction, the results obtained are substantially equivalent to those furnished by the complicated and expensive construction using an electric motor which is powered with direct current and with a "chopper" control.

The structure shown and described is exemplary. Variations and modifications are also within the scope of the inventor.

What is claimed is:

1. A clothes washing machine comprising a washing tub; a rotatable drum disposed in the tub for containing laundry to be washed; an electric motor for rotating the drum; two brackets for mounting the motor on the outside of the tub at a lower part of the tub; a seat provided with each bracket for accommodating a shaft of the motor; and shock absorbing means provided in the seats and capable of permitting absorption of vibration generated on the motor shaft during operation of the motor.

2. A clothes washing machine according to claim 1, wherein said shock absorbing means are formed by a rubber ring inserted into a bushing made of self-lubricating means.

3. A clothes washing machine according to claim 2, wherein each seat has a curved and elastically deformable edge which forms an axial abutment for the respective bushing.

4. A clothes washing machine according to claim 3, wherein at least one of the brackets is further connected to the motor by means of an elastic element.

5. A clothes washing machine according to claim 4, wherein the elastic element connects a pin provided on the bracket to a pin provided on a casing of the motor.

6. A clothes washing machine according to claim 1, wherein at least one of the brackets is further connected to the motor by means of an elastic element.

7. A clothes washing machine according to claim 6, wherein the elastic element connects a pin provided on the bracket to a pin provided on a casing of the motor.

8. A clothes washing machine according to claim 2, wherein at least one of the brackets is further connected to the motor by means of an elastic element.

9. A clothes washing machine according to claim 8, wherein the elastic element connects a pin provided on the bracket to a pin provided on a casing of the motor.

* * * * *